US005894202A

United States Patent [19]

Betz et al.

[11] Patent Number: 5,894,202

[45] Date of Patent: Apr. 13, 1999

[54] IGNITION DEVICE FOR GAS DISCHARGE LAMPS, PARTICULARLY FOR MOTOR VEHICLE LIGHTS

[75] Inventors: Dieter Betz; Ulrich Drews, both of Vaihingen; Thomas Gross, Waiblingen; Bernd Rothfuss, Niefern-Oeschelbronn; Thomas Kienzler, Reutlingen, all of Germany

[73] Assignee: Robert Bosch GmbH, Stuttgart, Germany

[21] Appl. No.: 08/765,200

[22] PCT Filed: Jun. 27, 1995

[86] PCT No.: PCT/DE95/00829

§ 371 Date: Jan. 3, 1997

§ 102(e) Date: Jan. 3, 1997

[87] PCT Pub. No.: WO96/01550

PCT Pub. Date: Jan. 18, 1996

[30] Foreign Application Priority Data

Jul. 5, 1994 [DE] Germany ..... 44 23 275

[51] Int. Cl.[6] ..... H05B 37/00

[52] U.S. Cl. ..... 315/289; 315/241 R; 315/DIG. 2

[58] Field of Search ..... 315/307, 308, 315/DIG. 5, 219, DIG. 2, 289, 176, 241 R

[56] References Cited

U.S. PATENT DOCUMENTS

| | | | |
|---|---|---|---|
| 3,758,815 | 9/1973 | Paget | 315/101 |
| 4,410,837 | 10/1983 | Suzuki et al. | 315/289 |
| 5,036,256 | 7/1991 | Garrison et al. | 315/308 |
| 5,233,273 | 8/1993 | Waki et al. | 315/224 |

*Primary Examiner*—Don Wong
*Assistant Examiner*—David H. Vu
*Attorney, Agent, or Firm*—Venable; Norman N. Kunitz; Allen Wood

[57] ABSTRACT

An ignition device for gas discharge lamps is proposed, in particular for motor vehicle lights. The ignition device contains a first transformer (17) which is supplied on its primary side with an alternating current produced from a direct current supply voltage. To generate this alternating current, a capacitor (14), which is acted upon by a charging current, constitutes a closed circuit together with the primary winding of the first transformer and a spark gap (16), wherein the spark gap (16) arcs at a predetermined charge state of the capacitor (14). This device makes a simple, inexpensive, and space-saving device possible for generating the required operating voltage for the transformer (17), wherein the spark gap can be reliably used, even at higher temperatures.

33 Claims, 1 Drawing Sheet

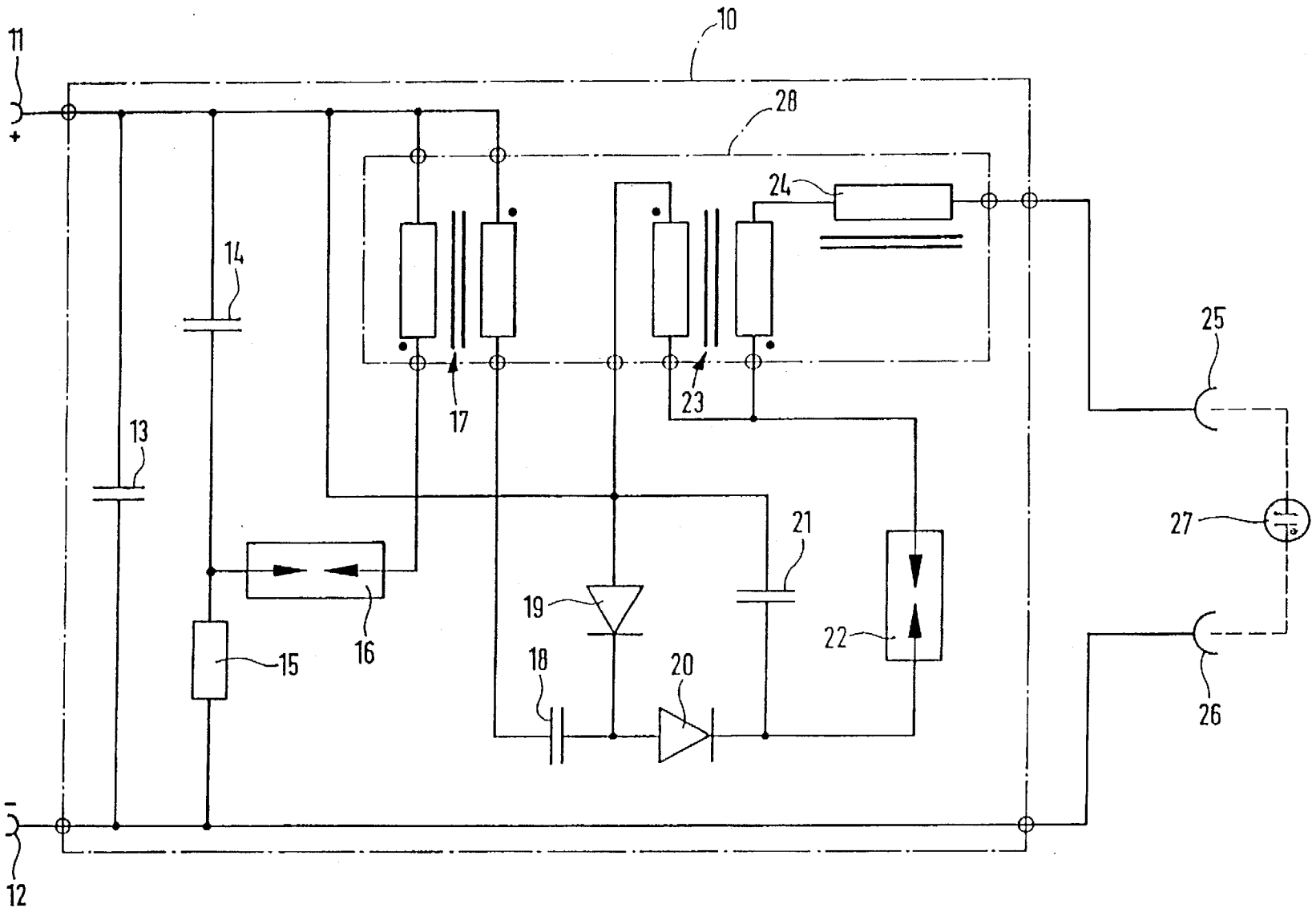
10
11
12
13
14
15
16
17
18
19
20
21
22
23
24
25
26
27
28
+
-

IGNITION DEVICE FOR GAS DISCHARGE LAMPS, PARTICULARLY FOR MOTOR VEHICLE LIGHTS

BACKGROUND OF THE INVENTION

The invention relates to an ignition device for gas discharge lamps, in particular for motor vehicle lights. The invention pertains to an ignition device of the general type in which a transformer has a secondary side that produces a gas discharge ignition voltage and a primary side that receives an alternating current produced from a direct current supply voltage.

Recently, various proposals have been made to use gas discharge lamps in motor vehicles, in particular in headlights. In addition to a longer service life, there are also advantages with regard to efficiency. Thus, for example, the same light intensity can be achieved with substantially less energy.

To turn on gas discharge lamps, ignition devices or ignition circuits are required, which produce the required high ignition voltage. Ignition devices of this kind are known, for example, from "Lamps and Lighting", Third Edition, 1983, Edward Arnold, pp. 292, 293. An ignition device is described there that has two transformers, wherein a device with controllable switches converts the direct current supply voltage into a pulsed voltage for powering the primary winding of the first transformer. A problem with it is its susceptibility to malfunction and its structural size, since rough vehicle use demands components that are not susceptible to malfunction and subassemblies that do not require much space.

SUMMARY OF THE INVENTION

The ignition device according to the invention may include a capacitor which constitutes a closed circuit together with the primary winding of the transformer and a spark gap and which is acted upon by a charging current. The ignition device according to the invention; and has the advantage that the spark gap used is very reliable for a long service life, and—in contrast to semiconductor switches—is also suited for higher temperatures. A particular trigger circuit is not required.

To generate the charging current for the capacitor, the direct current supply voltage is applied in a simple and cost effective manner to the series connection of this capacitor with a charging resistor. In a suitable manner, a smoothing capacitor is connected between the connecting terminals for the direct current supply voltage.

In order to reliably achieve the required high ignition voltage, the secondary winding of the transformer is advantageously followed by at least one other voltage increasing stage. For this purpose, the secondary winding of the transformer is embodied to charge another capacitor which in another voltage increasing stage, constitutes a circuit together with a switch and the primary winding of a second transformer, wherein the secondary winding of this second transformer produces the increased voltage. In a suitable manner, this switch is likewise embodied as another spark gap that arcs at a predetermined charge state of the other capacitor.

In order to be able to keep the size of the transformers small despite a high ignition voltage, the capacitor is a component of an additional voltage multiplication stage. Preferably, the capacitor, together with two diodes, constitutes a voltage doubling stage. At the same time, these diodes are used for producing the charging direct current for the other capacitor. This device can also be advantageously used in ignition devices in which the primary side alternating current for the first transformer is produced in another manner.

To increase operational reliability, during its transfer, the discharging current traveling through the lamp is limited by means of a current limiting device, preferably an inductor.

At least two of the inductive components are advantageously combined into one inductive unit, in particular by virtue of the fact that these components are inserted into a plastic housing that is open on one end and then are cast with a casting compound that fills the plastic housing. This achieves a small, compact component that is well-insulated on the high voltage end. To increase voltage reliability, this component can also have an output end high voltage connection leading out of one end of the unit and the other connections, which are acted on by a lesser voltage, leading out the opposite end of the unit. An inductive unit of this kind can also be advantageously used for other purposes in which a number of inductive components are provided.

BRIEF DESCRIPTION OF THE INVENTION

An exemplary embodiment of the invention is shown in the drawing and explained in detail in the following description. The sole FIGURE of the drawing shows a circuit diagram of an exemplary embodiment of the ignition device.

DESCRIPTION OF THE PREFERRED EMBODIMENT

The ignition device shown in the sole drawing FIGURE is embodied as assembly 10, which can, for example, be a housing or a cast block. The circuit of the ignition device is contained in the assembly 10 and has two direct current supply connections 11, 12 between which a smoothing capacitor 13 is connected. When used in motor vehicles, a direct current of 330 volts, for example, is applied to the supply connections 11, 12 and is generated by a preceding device, not shown.

The series connection of a capacitor 14 with a charging resistor 15 is connected parallel to the smoothing capacitor 13, and the series connection of a first switching such as spark gap 16 with the primary winding of a first transformer 17is connected parallel to the capacitor 14. The capacitor 14, together with the charging resistor 15 and the first spark gap 16, produces a pulsed voltage or alternating current for the operation of the first transformer 17.

The secondary winding of the first transformer 17 is connected to the positive supply connection 11. The other end of the secondary winding is connected, via a smoothing capacitor 18, to a rectifier- and voltage doubling stage comprised of two diodes 19, 20 and another capacitor 21. The anode of diode 19 and one terminal of the capacitor 21 are connected to the positive supply connection 11 and the cathode of diode 19 is connected to the connecting point between the smoothing capacitor 18 and the anode of the other diode 20, whose cathode is connected to the second terminal of the capacitor 21.

The capacitor 21, together with a second switch such as spark gap 22 and the primary winding of a second transformer 23, constitutes a closed circuit. The secondary winding of the second transformer 23 is connected to the connecting point between the primary winding and the second spark gap 22. The other end of the secondary winding is connected, via an inductor 24 or choke, to a first output connection 25. A second output connection 26 is attached to the negative supply connection 12.

A gas discharge lamp 27 can be connected between the two output connections 25, 26. This is shown by means of dashed lines.

The two transformers 17, 23 and the inductor 24 are in turn combined into a unit 28 inside the assembly 10.

By applying a direct current to the supply connections 11, 12, the capacitor 14 is charged via the charging resistor 15. When the switching voltage of the first spark gap 16 is achieved, it arcs and the capacitor 14 discharges via the primary winding of the first transformer 17. Then a new charging process begins. This causes the direct current to be pulsed and, in connection with the inductivity of the first transformer 17, produces a particular alternating current.

Due to the transformation ratio of the first transformer 17, a substantially higher secondary voltage is produced on its secondary side. As a result of the rectifier- and voltage doubling stage constituted by the diodes 19, 20 and the capacitor 21, this causes the capacitor 21 to be charged with an even higher voltage. Because of the two diodes 19, 20, both "half waves" of the alternating current produced are taken advantage of.

If the capacitor voltage of capacitor 21 now in turn reaches the switching voltage of the second spark gap 22, which is substantially higher than that of the first spark gap 16, then the second spark gap 22 arcs and the capacitor 21 discharges via the primary winding of the second transformer 23. As a result, on the secondary side of the second transformer 23, depending on the transformation ratio, an even higher secondary voltage is generated, which is supplied as the ignition voltage to the gas discharge lamp 27. The inductor 24 limits the discharge current through the gas discharge lamp 27.

In a simplified embodiment of the ignition device, the rectifier- and voltage doubling stage and the second transformer 23 can be eliminated, i.e. the secondary winding of the first transformer 17 would then be attached to the output or to the inductor 24.

It is also possible to use the rectifier- and voltage doubling stage in connection with the two transformers 17 and 23 also for ignition devices for gas discharge lamps in which the input end conversion of direct current into a pulsed or alternating current is carried out by other means than those described in this exemplary embodiment.

The unit 28 is comprised of a plastic housing that has an open end and is only schematically represented with dot-and-dash lines. The two transformers 17 and 23 and the inductor 24 are inserted into this plastic housing and then cast by means of filling the plastic housing up with a casting compound. The output end transformer 23 is already electrically connected to the inductor 24 before insertion into the plastic housing so that after casting, the electrical connection is disposed inside the casting compound. For example, the plastic housing is constructed and shaped so that the components inserted are securely positioned at the corresponding points or chambers and their position is maintained during casting.

The output of the unit 28 that is connected to the output connection 25 is acted upon by a high voltage and therefore leads out at a point on the unit disposed opposite from the other connections. These other connections are embodied for example as soldering connections for a printed circuit board so that the entire unit can be soldered to a printed circuit board and only the high voltage connection is disposed on an end region of the unit opposite from the printed circuit board. Naturally, it is also possible for the unit to contain, for example, only the output end transformer 23 and the inductor 24 and the other transformer 17 to be embodied as a separate component.

What is claimed is:

1. An ignition device for a gas discharge lamp, comprising:

a first transformer (17) having a primary side and a secondary side;

first means for supplying the primary side of the first transformer (17) with an alternating current produced from a direct current supply voltage, the first means including a capacitor (14) and a spark gap (16), the capacitor (14) and the spark gap (16) forming a closed circuit together with the primary side of the first transformer (17), the capacitor (14) receiving a charging current and the spark gap (16) arcing at a predetermined charge state of the capacitor (14);

second means for multiplying a voltage induced on the secondary side of the first transformer (17) to provide a multiplied voltage; and third means for increasing the multiplied voltage, the third means including a second transformer (23) having a primary side and a secondary side, the primary side of the second transformer (23) being connected to the second means.

2. The ignition device according to claim 1, wherein the first means further comprises a charging resistor (15), the direct current supply voltage being applied to a series connection of the capacitor (14) and the charging resistor (15).

3. The ignition device according to claim 1, further comprising a smoothing capacitor (13) connected between connecting terminals (11, 12) for the direct current supply voltage.

4. The ignition device according to claim 1, wherein the first and second transformers (17, 23) are combined into one unit (28).

5. The ignition device according to claim 1, wherein the second means comprises another capacitor (21), and wherein the third means further comprises a switch (22), the primary winding of the second transformer (23) forming closed circuit with the another capacitor (21) and the switch (22).

6. The ignition device according to claim 5, wherein the switch (22) comprises another spark gap that arcs at a predetermined charge state of the another capacitor (21).

7. The ignition device according to claim 6, wherein the second means further comprises a plurality of diodes (19, 20) which, together with the another capacitor (21), constitute a voltage doubling stage.

8. The ignition device according to claim 7, wherein the second means further comprises a smoothing capacitor (18) connected between the secondary winding of the first transformer (17) stage.

9. The ignition device according to claim 1, wherein the third means further comprises a current limiting device (24) that is connected between the secondary side of the second transformer (23) and the gas discharge lamp (27).

10. The ignition device according to claim 9, wherein the current limiting device (24) comprises an inductor.

11. The ignition device according to claim 10, wherein at least the second transformer (23) and the inductive current limiting device (24) are combined into one unit (28).

12. The ignition device according to claim 11, wherein the first transformer (17) is also disposed inside the unit (28).

13. The ignition device according to claim 12, wherein the unit (28) is comprised of a plastic housing that is open on one end, the first and second transformers (17, 23) and the inductive current limiting device (24) are disposed in the plastic housing, and a casting compound fills the plastic housing.

14. The ignition device according to claim 13, wherein the plastic housing, when empty, has a shape and construction that permits the first and second transformers (17, 23) and the inductive current limiting device (24) to be inserted.

15. The ignition device according to claim 12, wherein an output end high voltage connection leads out one end of the unit (28) and other connections, which are of a lesser voltage, lead out an opposite end of the unit (28).

16. The ignition device according to claim 15, wherein the other connections are embodied as solder connections for a printed circuit board.

17. An ignition device for a gas discharge lamp (27), comprising:

a first transformer (17) having a primary side and a secondary side;

first means for supplying the primary side of the first transformer (17) with an alternating current produced from a direct current supply voltage;

second means for multiplying a voltage induced on the secondary side of the first transformer (17) to provide a multiplied voltage; and third means for increasing the multiplied voltage to generate an output voltage that is supplied to the gas discharge lamp (27), the third means including a second transformer (23) having a primary side and a secondary side, the primary side of the second transformer (23) being connected to the second means.

18. The ignition device according to claim 17, further comprising a smoothing capacitor (13) connected between connecting terminals (11, 12) for the direct current supply voltage.

19. The ignition device of claim 17, wherein the second means comprises a capacitor (21), and wherein the third means further comprises a spark gap (22), the primary winding of the second transformer (23) forming a closed circuit with the capacitor (21) and the spark gap (22).

20. The ignition device according to claim 19, wherein the spark gap arcs at a predetermined charge state of the capacitor (21).

21. The ignition device according to claim 20, wherein the second means further comprises a plurality of diodes (19, 20) which, together with the capacitor (21), constitute a voltage doubling stage.

22. The ignition device according to claim 21, wherein the second means further comprises a smoothing capacitor (18) connected between the secondary winding of the first transformer (17) and the voltage doubling stage.

23. The ignition device according to claim 17, wherein the third means further comprise a current limiting device (24) that is connected between the secondary side of the second transformer (23) and the gas discharger lamp (27).

24. The ignition device according to claim 23, wherein the current limiting device (24) comprises an inductor.

25. The ignition device according to claim 24, wherein at least the second transformer (23) and the inductive current limiting device (24) are combined into one unit (28).

26. The ignition device according to claim 25, wherein the first transformer (17) is also disposed inside the unit (28).

27. The ignition device according to claim 26, wherein the unit (28) is comprised of a plastic housing that is open on one end, the first and second transformers (17, 23) and the inductive current limiting device (24) are disposed in the plastic housing, and a casting compound fills the plastic housing.

28. The ignition device according to claim 27, wherein the plastic housing, when empty, has a shape and construction that permits the first and second transformers (17, 23) and the inductive current limiting device (24) to be inserted.

29. The ignition device according to claim 26, wherein an output end high voltage connection leads out one end of the unit (28) and other connections, which are of a lesser voltage, lead out an opposite end of the unit (28).

30. The ignition device according to claim 29, wherein the other connections are embodied as solder connections for a printed circuit board.

31. An ignition device according to claim 17, wherein the first and second transformers (17, 23) are combined into one unit (28).

32. An ignition device for a gas discharge lamp (27), comprising:

a first transformer (17) having a primary side and a secondary side;

first means for supplying the primary side of the first transformer (17) with an alternating current produced from a direct current supply voltage;

second means for multiplying a voltage induced on the secondary side of the first transformer (17) to provide a multiplied voltage; and third means for increasing the multiplied voltage to generate an output voltage that is supplied to the gas discharge lamp (27), the third means including a second transformer (23) having a primary side and a secondary side, the primary side of the second transformer (23) being connected to the second means.

wherein the first means comprises a capacitor (14) and a spark gap (16), the capacitor (14) and the spark gap (16) forming a closed circuit together with the primary side of the first transformer (17), the capacitor (14) receiving a charging current and the spark gap (16) arcing at a predetermined charge state of the capacitor (14).

33. The ignition device according to claim 32, wherein the first means further comprises a charging resistor (15), the direct current supply voltage being applied to a series connection of the capacitor (14) and the charging resistor (15).

* * * * *